US005482808A

United States Patent [19]

Kondo et al.

[11] Patent Number: 5,482,808

[45] Date of Patent: Jan. 9, 1996

[54] ELECTROSTATIC IMAGE DEVELOPER

[75] Inventors: Kunio Kondo; Yujiro Fukuda, both of Tokyo, Japan

[73] Assignee: NEC Corporation, Tokyo, Japan

[21] Appl. No.: 217,512

[22] Filed: Mar. 24, 1994

[30] Foreign Application Priority Data

Mar. 25, 1993 [JP] Japan ..... 5-066366
Jun. 17, 1993 [JP] Japan ..... 5-145302

[51] Int. Cl.[6] ..... G03G 9/113
[52] U.S. Cl. ..... 430/111
[58] Field of Search ..... 430/110, 111, 430/108, 106

[56] References Cited

U.S. PATENT DOCUMENTS 5,118,588 6/1992 Nair et al. ..... 430/110
5,253,021 10/1993 Aslarn et al. ..... 430/124

FOREIGN PATENT DOCUMENTS 1233869 6/1971 United Kingdom .
1321651 6/1973 United Kingdom .

*Primary Examiner*—John Goodrow
*Attorney, Agent, or Firm*—Sughrue, Mion, Zinn, Macpeak & Seas

[57] ABSTRACT

Disclosed is an electrostatic image developer with negative chargeability which can give clear image quality and high image density by virtue of the toner, contained therein, having a small-diameter or a high content of fine toner particle, surface-modified with a fluoropolymer fine particle. The toner primarily consists of a polyester binder resin and a coloring pigment, and the toner has an average particle size of 9 μm or less, or a ≦4 μm fine toner particle content of at least 0.1% by weight. The toner is surface-modified with 0.1 to 10% by weight of a fluoropolymer fine particle having an average particle size smaller than that of the toner, in such a way that the ratio of the surface area of the fluoropolymer fine particle to that of the toner may be $10^{-3}$ to $10^{-1}$. Use of a polytetrafluoroethylene fine particle is preferred among other fluoropolymers, and a combination of the surface modification with the fluoropolymer fine particle and that with an inorganic fine particle is further preferred.

6 Claims, 1 Drawing Sheet

ELECTROSTATIC IMAGE DEVELOPER

BACKGROUND OF THE INVENTION

This invention relates to an electrostatic image developer used for developing latent electrostatic images in electrophotography, electrostatic recording, electrostatic printing, etc. More particularly, this invention relates to an electrostatic image developer with negative chargeability which can give clear image quality and high image density in spite of its small-diameter or the high content of fine toner particles.

There are well-known conventional developments of latent electrostatic image, and, for example in electrophotography, a uniformly charged photoconductor layer consisting of selenium, zinc oxide, a vinyl carbazole compound, cadmium sulfide, a phthalocyanine compound, etc. is subjected to light exposure with the same light image as depicted on a master drawing to extinguish the electrostatic charge on the exposed portions of the photoconductor to obtain a latent electrostatic image, on which a toner consisting of a binder resin, a coloring pigment and other additives is electrostatically deposited to form a toner image. The thus formed toner image is, as necessary, transferred to an image support such as paper, and then the toner thus transferred is fused by heating, softened or dissolved with a solvent or deformed by application of pressure to be permanently fixed onto the image support.

While various processes such as cascade development, powder cloud development, magnetic brush development, jumping development and touch down development are well known as the methods of latent electrostatic image development, the electrostatic image developers are roughly classified into two-component developer and single-component developer. The two-component developer consists of a toner and a carrier such as iron powders, steel beads, ferrites and glass beads, having a particle size larger than that of the toner, and the latent electrostatic image is developed by the toner charged through friction with the carrier. The single-component developer is further classified into magnetic single-component developer each of which consists of a toner and a magnetic substance such as triiron tetroxide, diiron trioxide and ferrite and forms a toner layer on a developer carrying member with the aid of the magnetic force and develops the latent electrostatic image; and non-magnetic single-component developer which develops latent electrostatic images formed by the toner layers on developer carrying member by means of contact electrification, triboelectrification, etc.

As such toner, a small particle prepared by using a thermoplastic resin as the binder resin, and dispersing a coloring pigment, a charge control agent and other additives into the resin by melt kneading, followed by finely milling and classification of the resulting composite to properly regulate the particle size is generally employed. Further, there is known a developer prepared by adding to such toner other materials so as to impart properties necessary as the developer.

While vinyl resins such as polystyrenes, acrylate polymers, styrene-acrylate copolymers and styrene-butadiene copolymers; and polyesters, epoxy resins, polyamides, polyurethanes, polycarbonates, fluoropolymers, silicone resins, phenol resins, maleic resins and coumarone resins are so far known as the thermoplastic resin, particularly the polyesters among others are excellent in (a) chargeability, (b) fixing property, (c) transparency, (d) gloss and (e) plasticizer in vinyl chloride migration resistance, and are practically utilized as the binder resin encouragingly in recent years.

Meanwhile, British Patents Nos. 1,233,869 and 1,321,651 disclose electrostatic image developers, in which the toners are admixed with fluoropolymer fine particles, with a view to preventing adhesion of the toners onto the photoconductor, the so-called filming phenomenon, during repeated procedures of development.

What is most important in developing the latent electrostatic image using such electrostatic image developer is the quality of the image to be finally obtained, so that developers having excellent resolving power, high gradation and high image density are desired. Under such circumstances, studies and efforts have been made so as to cope with the requirements by using toners having smaller particle sizes. The conventional toners have an average particle size on the order of 10 μm, and it is true that some effects can be identified for improving resolving power and gradation by using a toner having a smaller particle size, typically to an average particle size of 10 μm or less, particularly 8 μm or less.

But, when a latent electrostatic image is developed using such smaller-diameter toner, the image thus formed has a very low image density, disadvantageously, although it may have excellent resolving power and gradation. This is because the charge which the toner gains during the process of development is greatly changed by the reduced particle size of the toner. Namely, it is known that there is the following relationship: between the charge retained per toner particle and the particle size of the toner. In the above formula, q represents the charge (C) retained per toner particle; d represents the particle size (μm) of the toner; and n is 1 to 2. Accordingly, the toner charge to mass (C/g) becomes considerably high as the particle size of the toner becomes smaller, in reverse proportion. Thus, when a latent electrostatic image is developed, the amount of the toner necessary for electrically neutralizing the latent image formed on the photoconductor is lowered. Namely, the great reduction in the image density is attributable to the reduction of the amount of the toner to be electrostatically deposited to the latent image to form an image with a small level of toner deposition.

In order to obtain a small-diameter toner which can overcome the above problem, the toner charge to mass must be reduced. However, for obtaining such small-diameter toner satisfying the above requirements, the toner materials to be contained in the toner such as the binder resin, coloring pigment, charge control agent and other additives or the percentage composition thereof must be modified; the respective materials must newly be designed; or the material design and formulation design must be reconsidered. However, if a polyester resin having excellent charge stability is employed as the binder resin, it is difficult to reduce the toner charge to mass due to the excellent charge stability. Thus, the toner image formed using the polyester as the binder resin suffers a problem that the images formed thereby have extremely low image density. While it has been attempted to reduce the toner charge to mass by optimizing the acid value of the polyester resin by changing the carboxylic acids or alcohols to be applied as the monomer to the resin or by changing the percentage composition of the monomer, it proved difficult to satisfy various properties required of the toner including thermal properties, mechanical properties, etc. and also to reduce the charge on a great margin.

Further, fine toner particles contained in the toner, typically those having a diameter of 4 μm or less greatly reduce the image density due to the same reasons as described above. Namely, a large amount of fine particles contained in the toner increases the toner charge to mass and reduce the amount of the toner necessary for electrically neutralizing the latent image formed on the photoconductor, leading to the lowering of the image density. A classification step has conventionally been incorporated into the process of producing a toner so as to remove the fine particles. However, in the process of producing a small-diameter toner, it has been difficult to fully remove, in the classification step, a large amount of fine particles formed during the pulverizing step due to the limitation of the classification apparatus employed in the former step, and thus it has been extremely difficult to obtain a small-diameter toner which has a narrow particle size distribution and thus can give high image density. Meanwhile, if the cutpoint of classification is shifted to the larger particle side in the classification step so as to fully remove the fine particles, the toner yield is greatly reduced and the average particle size is increased, disadvantageously. Particularly when a toner containing as the binder resin a polyester is to be produced, the fine particle content tends to be higher compared with the case where a toner containing a styrene-acrylic resin as the binder resin is produced. Thus, it is difficult to obtain a toner image having high image density using such small-diameter toner containing a polyester resin.

Further, in the electrostatic image developer disclosed in the above-described patent literatures incorporated herein as reference, the fluoropolymer fine particle is allowed to present in the toner in an independent and free form, and intended solely to prevent filming. In addition, the lowering in the image density which occurs when a latent electrostatic image is developed using a small-diameter toner cannot be overcome by simply mixing the toner with the fluoropolymers as described in the above patent literatures.

SUMMARY OF THE INVENTION

Therefore, it is an object of the invention to provide an electrostatic image developer with negative chargeability which can give clear image quality and high image density in spite of its small-diameter or the large amount of the fine toner particles contained therein.

It is another object of the invention to provide a small-diameter electrostatic image developer with negative chargeability having reduced toner charge to mass, which can be achieved easily without reconsidering the material design or formulation design.

It is a further object of the invention to provide a small-diameter electrostatic image developer with negative chargeability which can be prepared without suffering a great yield reduction in the classification step.

The present inventors made extensive studies with a view to solving the above problems to find that such electrostatic image developer with negative chargeability which can give clear image quality and high image density can be obtained by using polyesters as the binder resin and a toner having an average particle size of 9 μm or less, or a ≦4 μm fine toner particle content of at least 0.1% by weight, and by surface-modifying the toner with 0.1 to 10% by weight of a fluoropolymer fine particle having an average particle size smaller than that of the toner, based on the amount of the toner, and they accomplished this invention.

This invention will be described below more specifically. According to this invention, a fluoropolymer fine particle having an average particle size smaller than that of the toner can be employed, and the average particle size of the polymer can be determined in terms of weight average particle size using a laser diffraction/scattering particle size analyzer and the like or in terms of number average particle size using a scanning electron microscope (SEM) and the like. It is essential that the average primary particle size of the fluoropolymer fine particle is smaller than the average particle size of the toner, and it is of no problem if the fine particle should be aggregated to form secondary particles. The fluoropolymer fine particle can be prepared by suspension polymerization, followed by low-temperature pulverization of the fluoropolymer or pulverization after irradiation of the fluoropolymer.

The fluoropolymer employable as the polymer fine particle includes polytetrafluoroethylene, tetrafluoroethylene-perfluoroalkyl ether copolymer, tetrafluoroethylene-hexafluoropropylene copolymer, tetrafluoroethylene-hexafluoropropylene-perfluoroalkyl vinyl ether copolymer, tetrafluoroethylene-ethylene copolymer, polyhlorotrifluoroethylene, chlorotrifluoroethylene-ethylene copolymer, polyvinylidene fluoride, polyvinyl fluoride and mixtures thereof. It is particularly preferred to use polytetrafluoroethylene, tetrafluoroethylene-perfluoroalkyl ether copolymer or tetrafluoroethylene-hexafluoropropylene copolymer as the fluoropolymer according to this invention. It should be understood that the effect of the invention shall not be limited to the properties of the fluoropolymer fine particle including molecular weight, molecular weight distribution, crystallinity and melting point.

According to this invention, the toner can be surface-modified with the fluoropolymer fine particle in an amount of 0.1 to 10% by weight, preferably 0.2 to 7% by weight, based on the amount of the toner. If the amount of the fluoropolymer fine particle used for the surface modification is less than 0.1% by weight, the effect of the invention, e.g. improvement of image density, image quality, etc., may not sufficiently be exhibited; whereas if it is more than 10% by weight, insufficient resolution and insufficient fixing of the developer are brought about.

It is preferred to carry out the surface modification in such a way that the ratio of the surface area of the fluoropolymer fine particles to that of the toner may be $10^{-3}$ to $10^{-1}$, particularly $10^{-2}$ to $10^{-1}$. The surface area ratio of the fluoropolymer fine particles to the toner particles is calculated assuming that they both have spherical forms. The surface area ratio is typically calculated based on the weight average particle sizes of the toner and the fluoropolymer fine particle and the numbers of particles per unit weight of them as measured using a laser diffraction/scattering particle size analyzer, a Coulter counter (manufactured by Coulter) and the like; or on the weight average particle sizes of them and the densities of them as measured by means of pycnometer method, density gradient tube method and the like.

The surface modification of the toner with the fluoropolymer fine particle can be carried out using the well-known methods of fixing or immobilizing the fluoropolymer onto the toner surface, for example, physical methods such as adhesion and immobilization of the fluoropolymer fine particle onto the toner surface utilizing mechanical shear, immobilization of the former onto the latter utilizing a combination of mixing and heating, and immobilization of the former onto the latter utilizing a combination of mixing and mechanical impact; and chemical methods, for example, immobilization of the former onto the latter by means of covalent bond between the toner and fine particles or of chemical bond such as hydrogen bond. The adhesion and immobilization of the fluoropolymer fine particle onto the toner surface utilizing the mechanical shear is particularly preferred in this invention. Such surface modification of the toner with a fluoropolymer fine particle can be carried out using a high-speed mixing surface modification apparatus, a coating type surface modification apparatus, a high-speed dry milling surface modification apparatus, etc. The high-speed mixing surface modification apparatus equipped with a high-speed stirring blade therein which allows the fluoropolymer fine particle to be adhered and immobilized onto the toner surface by the shear is particularly preferably used according to this invention. A particle of the toner surface-modified with a fluoropolymer fine particle according to this invention is schematically shown in FIG. 1, and this can easily be identified by SEM observation.

It is also possible to identify the surface modification of the toner with the fluoropolymer fine particle by checking number of particles per unit weight in the electrostatic image developer of the present invention by means of said laser diffraction/scattering particle size analyzer, a Coulter counter and the like. In other words, the surface modification in the present invention may be carried out to satisfy the following formula:

$$X \leqq T*W_t+F*W_f*0.2$$

wherein X is the number of particles per unit weight in the electrostatic image developer of the present invention, T is the number of particles per unit weight in the toner before the surface modification, F is the number of particles per unit weight in the fluoropolymer fine particle for use in the surface modification of the toner, $W_t$ is the weight fraction of the toner in the developer and $W_f$ is the weight fraction of the fluoropolymer fine particle in the developer.

As the toner employable according to this invention, a particle having an average particle size of 9 μm or less or a particle having a ≦4 μm fine toner particle content of at least 0.1% by weight can be used. The average particle size of the toner means the weight medium particle size and can be measured using a Coulter counter together with the fine toner particle content.

The toner is mainly composed of a polyester binder resin and a coloring pigment, and the raw materials well-known as the toner ingredients can be employed as the constituents. The polyester binder resin is prepared using a dicarboxylic acid, a diol and a phenol by the polycondensation therewith as constituent monomers, and the thus obtained toner binder resin is excellent in chargeability including polarity and charging stability. A polyester prepared by adding to the above constituent monomers a high valent carboxylic acid such as a tricarboxylic acid, a tetracarboxylic acid, a polycarboxylic acid or a carboxylic acid copolymer; a high valent alcohol such as a triol, a tetraol and a polyol; or an isocyanate compound to form a crosslinked structure within the resin may be used.

The dicarboxylic acid can be exemplified by maleic acid, citraconic acid, itaconic acid, fumaric acid, mesaconic acid, glutaconic acid (unsaturated aliphatic dicarboxylic acid), oxalic acid, malonic acid, succinic acid, glutaric acid, adipic acid, pimelic acid, suberic acid, azelaic acid, sebasic acid, cyclohexane dicarboxylic acid (saturated dicarboxylic acid), phthalic acid, isophthalic acid, terephthalic acid, 1,5-naphthalene dicarboxylic acid, 2,6-naphthalene dicarboxylic acid (aromatic dicarboxylic acid); as well as acid anhydrides and lower alkyl esters thereof.

The diol to be subjected to polycondensation with these dicarboxylic acids can be exemplified by ethylene glycol, diethylene glycol, triethylene glycol, 1,2-propylene glycol, 1,3-propylene glycol, dipropylene glycol, trimethylene glycol, 1,4-butanediol, 1,4-butenediol, 1,5-pentanediol, neopentyl glycol, 1,6-hexanediol, 1,7-heptanediol, 1,8-octanediol, 1,10-decanediol, pinacol, hydrobenzoin, benzpinacol, cyclopentane-1,2-diol, cyclohexane-1,2-diol, cyclohexane-1,4-diol and 1,4-bis(hydroxymethyl)cyclohexane.

The tricarboxylic acid can be exemplified by tricarballylic acid, 1,2,3-butanetricarboxylic acid, 1,2,4-butanetricarboxylic acid, 1,2,5-hexanetricarboxylic acid, 1,2,4-cyclohexane tricarboxylic acid, 1,2,4-benzene tricarboxylic acid, 2,5,7-naphthalene tricarboxylic acid, 1,2,4-naphthalene tricarboxylic acid; as well as acid anhydrides and lower alkyl esters thereof.

The triol can be exemplified by glycerol, 1,2,4-butanetriol, 1,2,5-pentanetriol, 2-methylpropanetriol, 2-methyl-1,2,4-butanetriol, trimethylolethane and trimethylolpropane.

The phenol can be exemplified by catechol, resorcinol, hydroquinone, pyrogallol, phloroglucinol, 1,2,4-benzenetriol, 1,3,5-trihydroxymethylbenzene, bisphenol A, hydrogenated bisphenol A, polyoxyethylene adduct of bisphenol A and polyoxypropylene adduct of bisphenol A.

Further, the above polyester binder resins may be used singly or as a mixture of two or more of them, or a block copolymer or a graft copolymer obtained by using two or more of these binder resins may also be employed. The above polyester resins may be mixed, block-copolymerized or graft-copolymerized with other resins. Such binder resins include, for example, vinyl resins such as polystyrenes, acrylate polymers, styrene-acrylate copolymers and styrene-butadiene copolymers; or epoxy resins, polyamides, polyurethanes, polycarbonates, fluoropolymers, silicone resins, phenol resins, maleic resins and coumarone resins.

It is particularly preferred according to this invention to use a polyester resin prepared using terephthalic acid, 1,2,4-benzenetricarboxylic acid, polyoxyethylene adduct of bisphenol A or polyoxypropylene adduct of bisphenol A; or a polyester resin EX-102 or EX-103 manufactured by Sanyo Chemical Industries, Ltd., prepared by graft polymerization of the above polyester resin consisting of a polycarboxylic acid and polyols with the backbone polymer novolak type phenol resin oxyalkylene ether prepared by adding an alkyleneoxide to a novolak type phenol resin.

Further, it is preferred to use a combination of surface modification of the toner with the fluoropolymer fine particle and surface modification of the toner with an inorganic fine powder. The intended effect of improving the image density according to this invention can more notably be exhibited by using the combination of the surface modification of the toner with the fluoropolymer and the surface modification of the toner with an inorganic fine particle.

It is essential that the inorganic fine particle preferably has a primary particle size of 0.001 to 2 μm, preferably 0.002 to 0.2 μm, and it is of no problem if the particles should be aggregated to form secondary particles. The inorganic fine particle is used for the surface modification of the toner in an amount of 0.1 to 5% by weight, particularly preferably in an amount of 0.1 to 1% by weight, based on the amount of the toner.

While the inorganic fine particle employable according to this invention is preferably a metal oxide fine particle, and can be exemplified by silica, tin oxide, aluminum oxide, titanium oxide, zinc oxide and these metal oxides surface modified, the silica fine particle referred to as dry process silica or colloidal silica formed by vapor phase oxidation of silicon halide is preferably employed according to this invention. Further, a hydrophobic silica prepared by surface modifying an essentially hydrophilic silica with a hydrophobisation agent may preferably be used. Such silica can be exemplified by hydrophobic silica prepared by substituting the silanol groups on the surface of the silica fine particle with organic groups through reaction between a silica fine particle and a silane coupling agent such as dichlorodimethylsilane, hexamethyldisilazane and trimethylsilane or a titanium coupling agent such as isopropyltriisostearoyl titanate, isopropyltridodecylbenzenesulfonyl titanate and tetraisopropyl bis(dioctylphosphate)titanate to make the surface of the silica fine particle hydrophobic.

As the surface modification of the toner with the inorganic fine particle, the same method as used for the surface modification of the toner with the fluoropolymer fine particle, i.e. physical methods such as adhesion and immobilization of the fine particle onto the toner surface utilizing mechanical shear, immobilization of the former onto the latter utilizing a combination of mixing and heating, and immobilization of the former onto the latter utilizing a combination of mixing and mechanical impact; chemical methods, for example, immobilization by means of covalent bond between the toner and fine particles or of chemical bond such as hydrogen bond; and simple mixing of the toner with the fine particle. The immobilization of the inorganic fine particle onto the toner surface utilizing the mechanical shear is particularly preferred in this invention. Such surface modification of the toner with the inorganic fine particle can be carried out using a high-speed mixing surface modification apparatus, a coating type surface modification apparatus, a high-speed dry milling surface modification apparatus, a V-type mixer, a conical screw mixer, a double conical mixer, a ball mill, a Turbula-Shaker-Mixer, etc. The high-speed mixing surface modification apparatus equipped with a high-speed stirring blade therein which allows the inorganic fine particle to be adhered and immobilized onto the toner surface by the shear is particularly preferably used according to this invention.

The surface modification of the toner with the inorganic fine particle may be carried out simultaneously with, or before or after the surface modification of the toner with the fluoropolymer fine particle.

Meanwhile, as the coloring pigment to be employed in the toner, any well-known coloring pigment such as carbon black, iron black, Ultramarine Blue, Aniline Blue, Phthalocyanine Blue, Phthalocyanine Green, Calco Oil Blue, Chrome Yellow, quinacridone, Indanthrene Blue, Peacock Blue, Permanent Red, Lake Red, Rhodamine Lake, Hansa Yellow, Permanent Yellow, Benzidine Yellow and Rose Bengal can be employed. While the amount of these coloring pigments to be added ranges widely, it is usually added in the range of 1 to 20 parts by weight per 100 parts by weight of the binder resin.

The toner may, as necessary, be incorporated with a known low-molecular weight polyolefins so as to prevent offset. The low-molecular weight polyolefins employable for such purpose includes, for example, polyolefins and co-polyolefins such as paraffin, chlorinated paraffin, polyethylene, chlorinated polyethylene, polyethylene oxide, ethylene-vinyl acetate copolymer, ethylene-acrylic acid copolymer, ethylene-acrylate copolymer, ethylene-methacrylic acid copolymer, ethylene-methacrylate copolymer, ethylene-vinyl chloride copolymer, ethylene-butene copolymer, ethylene-pentene copolymer, polypropylene, polypropylene oxide, ethylene-propylene copolymer, propylene-butene copolymer, propylene-pentene copolymer, ethylene-propylene-butene copolymer, ethylene-3-methyl 1-butene copolymer and polyisobutylene. These low-molecular weight polyolefins can be incorporated singly or in combination into the toner. While the polyolefin wax can be used over a wide range, it is usually added to the toner in an amount of 0.3 to 5 parts by weight based on the amount of the polyester binder resin.

Further, a charge control agent may, as necessary, be incorporated into the toner so as to regulate the charge level of the toner or stabilize the triboelectric properties of the toner. Such charge control agent employable according to this invention includes azo-metal complex compounds, chlorinated polyolefins, chlorinated polyesters, sulfonylamine of copper phthalocyanine, oil black, metal salts of naphthenic acid and metal salts of fatty acids.

For the purpose of imparting to the toner flowability, developing and transferring properties, storage stability, anti-filming property (resistance to filming of the photoconductor surface with the toner) and cleaning property, well-known external additives other than the inorganic fine particle may further be added. Such external additives include long-chain fatty acids such as stearic acid and esters, amides or metal salts thereof, carbon black, graphite, graphite fluoride and polycyclyl aromatic compounds. The addition of these external additives may be carried out simultaneously with, or before or after the surface modification of the toner with the fluoropolymer fine particle and with the inorganic fine particle.

A magnetic substance such as triiron tetroxide, diiron trioxide, ferrite, etc. may further be incorporated into the toner, or the toner surface-modified with the fluoropolymer fine particle of the invention may be mixed with a carrier such as iron powders, steel beads, ferrites and glass beads having a particle size greater than that of the toner can be employed as a magnetic developer and as a two-component developer, respectively.

The process for preparing the developer according to this invention will be described below. The toner of the invention can be prepared using a well-known technique. Namely, a polyester binder resin, a coloring pigment, a low-molecular weight polyolefin and a charge control agent are premixed, kneaded and dispersed over a heating roll, a Banbury mixer, an extruder, a kneader, etc. to give a composite. The composite is cooled and then roughly milled in a hammer mill and the like to a particle size of 1 mm or less, followed by pulverization step using a jet mill and further by classification step using a draft classifier, and the particles having a weight average particle size of 5 to 9 μm, or a fraction having a ≦4 μm fine toner particle content of at least 0.1% by weight is used as the toner. The thus obtained toner may further be surface-modified with the inorganic fine particle using a high-speed mixing surface modification apparatus and also surface modified with the fluoropolymer fine particle simultaneously with, or before or after the surface modification with the inorganic fine particle, and the resulting product can be used as the developer of the invention.

BRIEF DESCRIPTION OF THE DRAWING

The features of this invention that are believed to be novel are set forth with particularity in the appended claims. The invention, together with the objects and advantages thereof, may best be understood by reference to the following description of the preferred embodiments taken in conjunction with the accompanying drawing in which:

18

DESCRIPTION OF THE PREFERRED EMBODIMENT OF THE INVENTION

Figure 1:
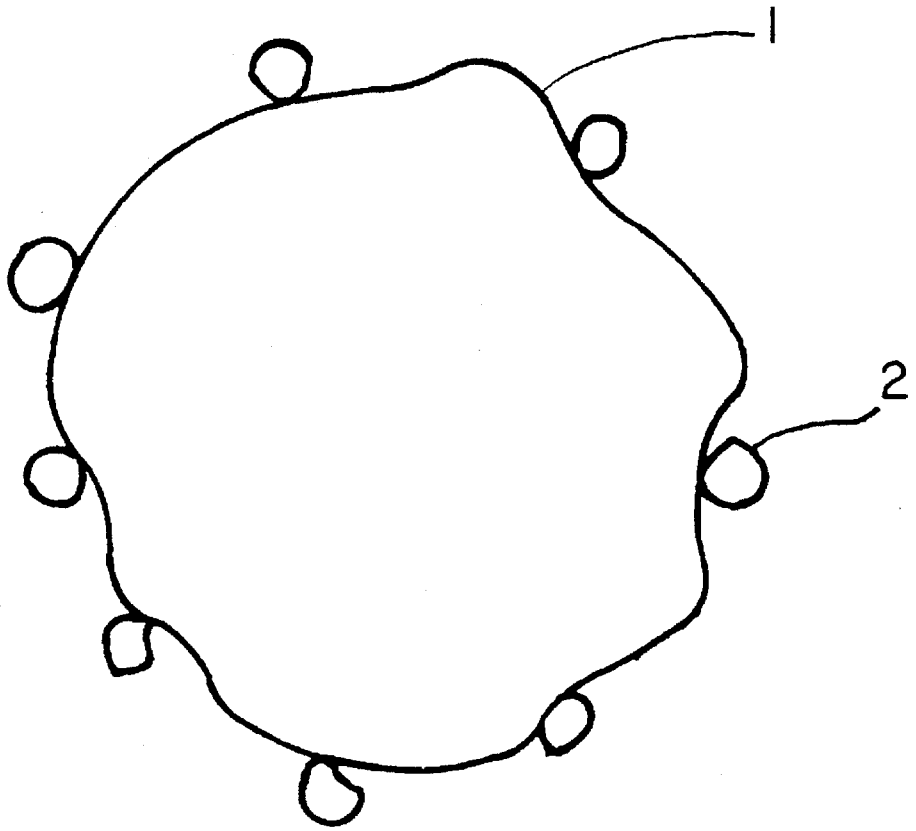
FIG. 1 shows a schematic view of the toner particle surface-modified with the fluoropolymer fine particle.

This invention will now be described by way of nonlimitative Preparation Examples and Examples together with Comparative Examples. It should be noted that the expressions "part (s)" mean all "part (s) by weight" based on the amount of the polyester binder resin.

(Preparation Example 1)

| | |
|---|---|
| Polyester resin (prepared from polyoxypropylene adduct of bisphenol A, polyoxyethylene adduct of bisphenol A, terephthalic acid and 1,2,4-benzenetricarboxylic anhydride as monomer): | 100 parts |
| Carbon black (MA-100, Mitsubishi Kasei Corp.): | 9 parts |
| Charge control agent (TRH, Hodogaya Chemical Co., Ltd.): | 2 parts |
| Low-molecular weight polypropylene (Biscol 550P, Sanyo Chemical Industries, Ltd.): | 1.5 parts |

The above raw material components were premixed and then continuously kneaded over a kneader heated to 150° C. The composite thus obtained was cooled to room temperature and roughly milled to about 1 mm×1 mm using a cutter mill, followed by pulverization in a jet mill and then by classification in a draft classifier to provide a toner. The toner had a weight average particle size of 10 μm, had a ≦4 μm fine toner particle content of 0.3% by weight and had the number of particles per unit weight of $238\times10^7$/g.

(Preparation Example 2)

A toner was prepared in the same manner as in Preparation Example 1 except that a polyester resin (EX-103, manufactured by Sanyo Chemical Industries, Ltd.) was used as the binder resin, and that the weight average particle size and the ≦4 μm fine toner particle content were 7.2 μm and 1.9% by weight, respectively. The toner prepared had the number of particles per unit weight of $633\times10^7$/g.

(Preparation Example 3)

A toner was prepared in the same manner as in Preparation Example 1 except that a polyester resin (EX-103, manufactured by Sanyo Chemical Industries, Ltd.) was used as the binder resin, and that the weight average particle size and the ≦4 μm fine toner particle content were 7.5 μm and 0% by weight, respectively. The toner prepared had the number of particles per unit weight of $445\times10^7$/g.

(Preparation Example 4)

A toner was prepared in the same manner as in Preparation Example 1 except that a polyester resin (EX-102, manufactured by Sanyo Chemical Industries, Ltd.) was used as the binder resin, and that the weight average particle size and the ≦4 μm fine toner particle content were 6.8 μm and 4.0% by weight, respectively. The toner prepared had the number of particles per unit weight of $751\times10^7$/g.

(EXAMPLE 1)

The toner obtained in Preparation Example 1 was surface-modified with 0.4% by weight of a hydrophobic silica (R972, manufactured by Nippon Aerosil) based on the amount of the toner using a high-speed mixing surface modification apparatus and then with 0.2% by weight of a polytetrafluoroethylene fine particle having a number average primary particle size of 0.3 μm and a weight average secondary particle size of 2.5 μm based on the amount of toner using the same apparatus to provide a developer. The ratio of the surface area of the polytetrafluoroethylene fine particle to that of the toner was 0.074.

The number of particles per unit weight in the developer was $197\times10^7$/g (excepting the number of hydrophobic silica); whereas the number of particles in the polytetrafluoroethylene fine particle and the number of particles in the toner before the surface modification were $673\times10^8$/g and $238\times10^7$/g, respectively, in conversion to the number of particles per unit weight of the developer after the surface modification.

The developer thus obtained was charged to a commercially available PC-PR 1000 printer (manufactured by NEC) equipped with a titanyl phthalocyanine photoconductor and a hot roll fuser, followed by repeated development and fixing to evaluate the image density and image quality. The image density was determined by measuring the values at five points arbitrarily selected on a solid black image obtained after 5000 prints using a Macbeth densitometer and calculating the average of the optical reflection density values. The solid black image formed by using this developer had a high image density of 1.45. No deterioration in the image quality was observed even after 10000 prints, and the same clear image quality as in the initial print was reproduced.

(EXAMPLE 2)

The toner obtained in Preparation Example 1 was surface-modified simultaneously with 0.4% by weight of a hydrophobic silica (R972, manufactured by Nippon Aerosil) and with 1.3% by weight of a polytetrafluoroethylene fine particle having a weight average particle size of 3 μm, based on the amount of toner, using the high-speed mixing surface modification apparatus to provide a developer. The ratio of the surface area of the polytetrafluoroethylene fine particle to that of the toner was 0.049.

The number of particles per unit weight in the developer was $219\times10^7$/g (excepting the number of hydrophobic silica); whereas the number of particles in the polytetrafluoroethylene fine particle and the number of particles in the toner before the surface modification were $440\times10^6$/g and $235\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.40. No deterioration in the image quality was observed even after 10000 prints, and the same clear image quality as in the initial print was reproduced.

(EXAMPLE 3)

The surface modification of Example 2 was repeated analogously, except that the polyteterafluoroethylene fine particle was replaced by a tetrafluoroethyleneperfluoroalkyl ether copolymer fine particle having a weight average particle size of 3.5 μm to provide a developer. The ratio of the surface area of the tetrafluoroethylene-perfluoroalkyl ether copolymer fine particle to that of the toner was 0.042.

The number of particles per unit weight in the developer was $234\times10^7$/g (excepting the number of hydrophobic silica); whereas the number of particles in the polytetrafluoroethylene-perfluoroalkyl ether copolymer fine particle and the number of particles in the toner before the surface modification were $280\times10^6$/g and $235\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.36. No deterioration in the image quality was observed even after 10000 prints, and the same clear image quality as in the initial print was reproduced.

(EXAMPLE 4)

The toner obtained in Preparation Example 2 was surface-modified with 4% by weight of a polytetrafluoroethylene fine particle having a weight average particle size of 7 μm using a high-speed mixing surface modification apparatus and then with 0.7% by weight of a hydrophobic silica (R972, manufactured by Nippon Aerosil), based on the amount of the toner, using the same apparatus to provide a developer. The ratio of the surface area of the polytetrafluoroethylene fine particle to that of the toner was 0.018.

The number of particles per unit weight in the developer was $610\times10^7$/g (excepting the number of hydrophobic silica); whereas the number of particles in the polytetrafluoroethylene fine particle and the number of particles in the toner before the surface modification were $110\times10^6$/g and $608\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.38. No deterioration in the image quality was observed even after 10000 prints, and the same clear image quality as in the initial print was reproduced.

(EXAMPLE 5)

The toner obtained in Preparation Example 2 was surface-modified with 0.2% by weight of a hydrophobic silica (R972, manufactured by Nippon Aerosil) using a high-speed mixing surface modification apparatus and then with 0.4% by weight of a polytetrafluoroethylene fine particle having a number average primary particle size of 0.3 μm and a weight average secondary particle size of 2.5 μm, based on the amount of toner, using the same apparatus to provide a developer. The ratio of the surface area of the polytetrafluoroethylene fine particle to that of the toner was 0.040.

The number of particles per unit weight in the developer was $725\times10^7$/g (excepting the number of hydrophobic silica); whereas the number of particles in the polytetrafluoroethylene fine particle and the number of particles in the toner before the surface modification were $135\times10^9$/g and $630\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.43. No deterioration in the image quality was observed even after 10000 prints, and the same clear image quality as in the initial print was reproduced.

(EXAMPLE 6)

The surface modification of Example 5 was repeated analogously, except that the hydrophobic silica was replaced by a colloidal silica (No. 200, manufactured by Nippon Aerosil) subjected to no hydrophobic modification to provide a developer. The ratio of the surface area of the polytetrafluoroethylene fine particle to that of the toner was 0.040.

The number of particles per unit weight in the developer was $682\times10^7$/g (excepting the number of colloidal silica); whereas the number of particles in the polytetrafluoroethylene fine particle and the number of particles in the toner before the surface modification were $135\times10^9$/g and $630\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.41. No deterioration in the image quality was observed even after 10000 prints, and the same clear image quality as in the initial print was reproduced.

(EXAMPLE 7)

The toner obtained in Preparation Example 2 was surface-modified simultaneously with 0.2% by weight of a hydrophobic silica (R972, manufactured by Nippon Aerosil) and with 4% by weight of a tetrafluoroethylene-hexafluoropropylene copolymer fine particle having a weight average particle size of 2 μm, based on the amount of toner, using a high-speed mixing surface modification apparatus to provide a developer. The ratio of the surface area of the tetrafluoroethylene-hexafluoropropylene copolymer fine particle to that of the toner was 0.063.

The number of particles per unit weight in the developer was $611\times10^7$/g (excepting the number of hydrophobic silica); whereas the number of particles in the polytetrafluoroethylene-hexafluoropropylene copolymer fine particle and the number of particles in the toner before the surface modification were $455\times10^7$/g and $608\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.47. No deterioration in the image quality was observed even after 10000 prints, and the same clear image quality as in the initial print was reproduced.

(EXAMPLE 8)

The toner prepared in Preparation Example 2 was surface-modified solely with 0.4% by weight of a polytetrafluoroethylene fine particle having a number average primary particle size of 0.3 μm and a weight average secondary particle size of 2.5 μm using a high-speed mixing surface modification apparatus to provide a toner. The ratio of the surface area of the polytetrafluoroethylene fine particle to that of the toner was 0.040.

The number of particles per unit weight in the developer was $627\times10^7$/g; whereas the number of particles in the polytetrafluoroethylene fine particle and the number of particles in the toner before the surface modification were $135\times10^9$/g and $630\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.31. No deterioration in the image quality was observed even after 10000 prints, and the same clear image quality as in the initial print was reproduced.

(EXAMPLE 9)

The surface modification of Example 2 was repeated analogously, except that the polyteterafluoroethylene fine particle was added in an amount of 2.2% by weight to the toner obtained in Preparation Example 3 to provide a developer. The ratio of the surface area of the polytetrafluoroethylene fine particle to that of the toner was 0.034.

The number of particles per unit weight in the developer was $434\times10^7$/g (excepting the number of hydrophobic silica); whereas the number of particles in the polytetrafluoroethylene fine particle and the number of particles in the toner before the surface modification were $740\times10^6$/g and $436\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.38. No deterioration in the image quality was observed even after 10000 prints, and the same clear image quality as in the initial print was reproduced.

(EXAMPLE 10)

The surface modification of Example 9 was repeated analogously, except that the polyteterafluoroethylene fine particle was replaced with a polytetrafluoroethylene fine particle having a number average primary particle size of 0.3 μm and a weight average secondary particle size of 2.5 μm and that the polytetrafluoroethylene fine particle was added in an amount of 0.6% by weight based on the amount of the toner to provide a developer. The ratio of the surface area of the polytetrafluoroethylene fine particle to that of the toner was 0.090.

The number of particles per unit weight in the developer was $586\times10^7$/g (excepting the number of hydrophobic silica); whereas the number of particles in the polytetrafluoroethylene fine particle and the number of particles in the toner before the surface modification were $202\times10^9$/g and $443\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.44. No deterioration in the image quality was observed even after 10000 prints, and the same clear image quality as in the initial print was reproduced.

(EXAMPLE 11)

The toner obtained in Preparation Example 4 was surface-modified with 0.4% by weight of a hydrophobic silica (R972, manufactured by Nippon Aerosil) based on the amount of the toner using a high-speed mixing surface modification apparatus and then with 3.0% by weight of a polytetrafluoroethylene fine particle having a weight average particle size of 3 μm based on the amount of toner using the same apparatus to provide a developer. The ratio of the surface area of the polytetrafluoroethylene fine particle to that of the toner was 0.022.

The number of particles per unit weight in the developer was $839\times10^7$/g (excepting the number of hydrophobic silica); whereas the number of particles in the polytetrafluoroethylene fine particle and the number of particles in the toner before the surface modification were $101\times10^7$/g and $833\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.44. No deterioration in the image quality was observed even after 10000 prints, and the same clear image quality as in the initial print was reproduced.

(EXAMPLE 12)

The surface modification of Example 10 was repeated analogously, except that the polyteterafluoroethylene fine particle was added in an amount of 0.5% by weight to the toner obtained in Preparation Example 4 to provide a developer. The ratio of the surface area of the polytetrafluoroethylene fine particle to that of the toner was 0.035.

The number of particles per unit weight in the developer was $851\times10^7$/g (excepting the number of hydrophobic silica); whereas the number of particles in the polytetrafluoroethylene fine particle and the number of particles in the toner before the surface modification were $168\times10^9$/g and $855\times10^7$/g, respectively, in conversion to the number of particles per unit weight of the developer after the surface modification.

The developer thus obtained was charged to a PC-PR 1000 printer, followed by repeated development and fixing in the same manner as in Example 1 to evaluate the image density and image quality. The solid black image formed by using this developer had a high image density of 1.49. No deterioration in the image quality was observed even after 10000 prints, and the same clear image quality as in the initial print was reproduced.

(Comparative Example 1)

The toner obtained in Preparation Example 1 was surface-modified with 0.4% by weight of a hydrophobic silica (R972, manufactured by Nippon Aerosil) based on the amount of the toner using a high-speed mixing surface modification apparatus to provide a developer.

The developer thus obtained was charged to a PC-PR 1000 printer, followed by repeated development and fixing in the same manner as in Example 1 to evaluate the image density and image quality. The solid black image formed by using this developer had a low image density of 1.28.

(Comparative Example 2)

The toner obtained in Preparation Example 3 was surface-modified with 0.2% by weight of a hydrophobic silica (R972, manufactured by Nippon Aerosil) based on the amount of the toner using a high-speed mixing surface modification apparatus to provide a developer.

The developer thus obtained was charged to a PC-PR 1000 printer, followed by repeated development and fixing in the same manner as in Example 1 to evaluate the image density and image quality. The solid black image formed by using this developer had a very low image density of 1.17.

(Comparative Example 3)

The toner obtained in Preparation Example 2 was surface-modified with 0.2% by weight of a polytetrafluoroethylene fine particle having a weight average particle size of 7 μm based on the amount of the toner using a high-speed mixing surface modification apparatus and then with 0.4% by weight of a hydrophobic silica (R972, manufactured by Nippon Aerosil) based on the amount of the toner using the same apparatus to provide a developer. The ratio of the surface area of the polytetrafluoroethylene fine particle to that of the toner was 0.0009.

The developer thus obtained was charged to a PC-PR 1000 printer, followed by repeated development and fixing in the same manner as in Example 1 to evaluate the image density and image quality. The solid black image formed by using this developer had a low image density of 1.19.

(Comparative Example 4)

The toner obtained in Preparation Example 4 was surface-modified simultaneously with 0.4% by weight of a hydrophobic silica (R972, manufactured by Nippon Aerosil) and with 0.1% by weight of a polytetrafluoroethylene fine particle having a weight average particle size of 3 μm, based on the amount of toner, using a high-speed mixing surface modification apparatus to provide a developer. The ratio of the surface area of the polytetrafluoroethylene fine particle to that of the toner was 0.0007.

The developer thus obtained was charged to a PC-PR 1000 printer, followed by repeated development and fixing in the same manner as in Example 1 to evaluate the image density and image quality. The solid black image formed by using this developer had a low image density of 1.25.

(Comparative Example 5)

The toner obtained in Preparation Example 4 was surface-modified with 0.4% by weight of a hydrophobic silica (R972, manufactured by Nippon Aerosil) and 4% by weight of a polytetrafluoroethylene fine particle having a number average primary particle size of 0.3 μm and a weight average secondary particle size of 2.5 μm, based on the amount of toner, concurrently, using a high-speed mixing surface modification apparatus to provide a developer. The ratio of the surface area of the polytetrafluoroethylene fine particle to that of the toner was 0.291.

The developer thus obtained was charged to a PC-PR 1000 printer, followed by repeated development and fixing in the same manner as in Example 1 to evaluate the image density and image quality. From the initial stage of printing, considerable smudges of non-image portion, namely background fog, and no good fixation occurred and so no clear reproduction of image could be obtained.

(Comparative Example 6)

The toner obtained in Preparation Example 1 was surface-modified with 0.4% by weight of a hydrophobic silica (R972, manufactured by Nippon Aerosil) based on the amount of the toner using a high-speed mixing surface modification apparatus and then simply mixed with 4.0% by weight of a polytetrafluoroethylene fine particle having a weight average particle size of 3 μm based on the amount of toner using a Turbula-Shaker-Mixer (trade name) to provide a developer. The ratio of the surface area of the polytetrafluoroethylene fine particle to that of the toner was 0.175.

The number of particles per unit weight in the developer was $332\times10^7$/g (excepting the number of hydrophobic silica); whereas the number of particles in the polytetrafluoroethylene fine particle and the number of particles in the toner before the surface modification and mixing were $135\times10^7$/g and $202\times10^7$/g, respectively, in conversion to the number of particles per unit weight of the developer after the surface modification and mixing.

The developer thus obtained was charged to a PC-PR 1000 printer, followed by repeated development and fixing in the same manner as in Example 1 to evaluate the image density and image quality. From the initial stage of printing, whitening of image portion, considerable background fog and no good fixation occurred and so no clear reproduction of image could be obtained.

While the effect of the invention was observed particularly notably in the electrostatic image developers containing polyester resins as the binder resins, some degree of effect was obtained even when the present invention was applied to the electrostatic image developers containing other well-known toner resins as the binder resins.

The electrostatic image developers according to this invention exhibits many excellent effects. Namely, when latent electrostatic images are to be developed using a prior art developer containing a small-diameter toner so as to obtain superior resolving power and gradation, the images thus formed come to have low image density, disadvantageously. However, the developer containing a small-diameter toner provided according to this invention suffers no such problem and can give high image density without reconsidering the material design or formulation design or causing great reduction in the toner yield in the classification step.

What is claimed is:

1. An electrostatic image developer comprising a toner containing a polyester binder resin and a coloring pigment as major components; wherein said toner has an average particle size of 9 μm or less, or contains at least 0.1% by weight of fine toner particles having a particle size of 4 μm or less; said toner being surface-modified with 0.1 to 10% by weight of a fluoropolymer fine particle having an average particle size smaller than that of said toner, based on the amount of said toner; and said surface modification being carried out in such a way that the ratio of the surface area of said fluoropolymer fine particle to that of said toner may be $10^{-3}$ to $10^{-1}$.

2. The electrostatic image developer according to claim 1, wherein the surface modification is carried out to satisfy the following formula:

$$X \leqq T*W_t+F*W_f*0.2$$

wherein X is the number of particles per unit weight in the electrostatic image developer, T is the number of particles per unit weight in the toner before the surface modification, F is the number of particles per unit weight in the fluoropolymer fine particle for use in the surface modification of the toner, $W_t$ is the weight fraction of the toner in the developer and $W_f$ is the weight fraction of the fluoropolymer fine particle in the developer.

3. The electrostatic image developer according to claim 1, wherein said fluoropolymer is a polytetrafluoroethylene fine particle.

4. The electrostatic image developer according to claim 1, wherein said toner is surface-modified with a fluoropolymer fine particle and with 0.1 to 5% by weight of an inorganic fine particle based on the amount of said toner.

5. The electrostatic image developer according to claim 4, wherein said inorganic fine particle is a colloidal silica.

6. The electrostatic image developer according to claim 5, wherein said colloidal silica is a hydrophobic silica surface-modified with a hydrophobisation agent.

* * * * *

UNITED STATES PATENT AND TRADEMARK OFFICE
CERTIFICATE OF CORRECTION

PATENT NO. : 5,482,808
DATED : January 9, 1996
INVENTOR(S) : Kunio KONDO, Yujiro FUKUDA It is certified that error(s) appears in the above-identified patent and that said Letters Patent is hereby corrected as shown below:

Col. 2, line 31, after "relationship:", insert --$q \propto d^n$ --.

Col. 4, lines 21 and 22, delete "polyhlorotrifluoroethylene", insert --polychlorotrifluoroethylene--.

Col. 8, line 66, delete "18".

Signed and Sealed this

Twenty-fifth Day of June, 1996

*Attest:*

Bruce Lehman

BRUCE LEHMAN

*Attesting Officer*

*Commissioner of Patents and Trademarks*